US005915632A

United States Patent [19]

Muratsubaki et al.

[11] Patent Number: 5,915,632

[45] Date of Patent: Jun. 29, 1999

[54] SLIDER FOR SLIDE FASTENER

[75] Inventors: Koji Muratsubaki; Takeshi Nozaka, both of Toyama, Japan

[73] Assignee: YKK Corporation, Tokyo, Japan

[21] Appl. No.: 09/052,139

[22] Filed: Mar. 31, 1998

[30] Foreign Application Priority Data

Mar. 31, 1997 [JP] Japan ..... 9-080640

[51] Int. Cl.[6] ..... A44B 19/26

[52] U.S. Cl. ..... 24/429; 24/419; 24/424

[58] Field of Search ..... 24/415, 419, 423, 24/424, 403, 429, 431

[56] References Cited

U.S. PATENT DOCUMENTS

| | | | |
|---|---|---|---|
| 2,542,547 | 2/1951 | Marinsky | 24/424 |
| 2,904,868 | 9/1959 | Goeser . | |
| 3,641,634 | 2/1972 | Asai | 24/429 |
| 4,928,358 | 5/1990 | Ishii et al. | 24/429 X |
| 4,980,954 | 1/1991 | Takabatake et al. | 24/429 X |
| 4,985,969 | 1/1991 | Terada et al. | 24/429 |
| 5,031,286 | 7/1991 | Kedzierski | 24/429 X |
| 5,093,966 | 3/1992 | Yuki et al. | 24/429 |
| 5,568,674 | 10/1996 | Harada et al. | 24/419 X |

FOREIGN PATENT DOCUMENTS

| | | |
|---|---|---|
| 0 099 484 | 2/1984 | European Pat. Off. . |
| 0 423 570 A1 | 4/1991 | European Pat. Off. . |

*Primary Examiner*—James R. Brittain
*Assistant Examiner*—Robert J. Sandy
*Attorney, Agent, or Firm*—Hill & Simpson

[57] ABSTRACT

A small and free type slider for a slide fastener fitted to the slit of an inside pocket of a wearing article can effectively prevent it from scraping the edges of the fabric of the pocket and operate smoothly, buffering any undesirable collision between the slider and the edges of the pocket. It comprises a slider body having an upper wing, a lower wing and a guide post rigidly linking the upper and lower wings and a pull tab holder projecting transversally from about a center of the upper surface of the upper wing, a pull tab directly or indirectly linked to the slider body and a pair of protuberances are projecting upward from the upper surface of the upper wing in front and at the back of the pull tab holder respectively and spaced apart from the pull tab holder.

9 Claims, 8 Drawing Sheets

SLIDER FOR SLIDE FASTENER

BACKGROUND OF THE INVENTION

1. Field of the Invention

This invention relates to a slider for a small and free type slide fastener that can suitably be fitted to the slit of an inside pocket of a suit or an overcoat or of a pocket of a casual jacket to close and open the pocket.

2. Description of the Related Art

FIG. 8 of the accompanying drawings illustrates a known slider for a slide fastener disclosed in Japanese Utility Model Application Laid-Open No. 58-118915 that can suitably be fitted to a pocket of a wearing article. It comprises a pull tab 2', an annular link 3' and a pull tab holder 9' projecting from the upper surface of the upper wing 4' of a slider body 1' for transversally holding the annular link 3' so that the pull tab 2' may be transversally suspended from the pull tab holder 9' with the annular link 3' disposed therebetween.

FIG. 9 of the accompanying drawings illustrates another known slider for a slide fastener disclosed in Japanese Utility Model Application Laid-Open No. 59-15309. It also comprises a pull tab 2", a link 3" having a circular opening 18*a*" and a polygonal opening 18*b*" and a pull tab holder 9" projecting from the upper surface of the upper wing 4" of a slider body 1" for transversally holding the link 3" through the circular opening 18*a*" so that the pull tab 2" is held by the link 3" through the polygonal opening 18*b*" and may be transversally suspended from the pull tab holder 9" with the link 3" disposed therebetween.

Both of the sliders to be used for a slide fastener as described above and illustrated in FIGS. 8 and 9 do not have any bulge located near the pull tab holder 9', 9" projecting transversally from the upper surface of the slider body 1', 1" so that the upper surface of the slider body 1', 1" is flat except the pull tab holder 9', 9". Therefore, the edges of the wearing article provided with the slide fastener and a lining can be scraped and damaged by the pull tab holder 9', 9" to make the sliding motion of the slider rather heavy and unsmooth.

In addition, the link 3" of the slider of FIG. 9 having a circular opening 18*a*" for connecting it to the slider body 1" and a polygonal opening 18*b*" for connecting it to the pull tab 2" can swing, with respect to the slider body 1", within a limited range in given plane; but the link 3" cannot swing with respect to the pull tab 2" in any single plane. Therefore, the motion of the pull tab 2" is limited and unsmooth if it is operated.

In view of the above identified problems of the prior art, it is therefore a first object of the present invention to provide a small and free type slider for a slide fastener fitted to the slit of an inside pocket of a wearing article, wherein the edges of the wearing article provided with the slide fastener and a lining would not be scraped and damaged by the pull tab holder so that the sliding motion of the slider may be light and smooth and the slider may not damage the wearing article when pressed by a press iron, for example. Also, the slider is neat in appearance because the pull tab suspends from the slider body in a transverse direction.

A second object of the invention is to provide a small and free type slider for a slide fastener as described above, wherein the slider can softly wedge away the edges of the wearing article provided with the slide fastener and a lining as it is operated along a fastener stringer in order to minimize the resistance against the sliding motion of the slider.

A third object of the invention is to provide a small and free type slider for a slide fastener as described above, wherein the pull tab holder arranged on the upper surface of the slider body has a specifically designed profile so that the slider may be operated in a specific way.

A fourth object of the invention is to provide a small and free type slider for a slide fastener as described above, wherein the pull tab can swing freely and operate properly if pulled in any direction because of a specifically designed link for indirectly connecting the pull tab and the pull tab holder so that consequently the slider may be operated smoothly.

A fifth object of the invention is to provide a small and free type slider for a slide fastener as described above, wherein the pull tab has a specifically designed profile and is directly fitted to the pull tab holder so that the pull tab may swing freely and the pulling force applied to the pull tab is directly transmitted to the slider body without reduction to make the slider operate smoothly.

SUMMARY OF THE INVENTION

According to a first aspect of the invention, the above first object is achieved by a slider for a slide fastener as follows. The slider comprises a slider body and a pull tab directly or indirectly linked to the slider body. The slider body includes an upper wing, a lower wing, and a guide post rigidly linking the upper and lower wings. The slider body further comprises a pull tab holder, which is projecting transversally from about a center of an upper surface of the upper wing, and a pair of protuberances, which are projecting upward from the upper surface of the upper wing in front and at the back of the pull tab holder respectively. The protuberances are spaced apart from the pull tab holder.

According to a second aspect of the invention, the pull tab holder includes a pair of legs projecting from the upper surface of the slider body and defining a U-shaped space therebetween. Further, the protuberances projecting upward in front and at the back of the pull tab holder have a transversally oblong elliptic plan view.

According to a third aspect of the invention, the pull tab holder includes a pair of legs projecting from the upper surface of the slider body and defining a U-shaped space therebetween. Further, the protuberances projecting upward in front and at the back of the pull tab holder have generally semicircular plan views with their respective arched edges curved toward front and rear ends of the upper wing.

According to a fourth aspect of the invention, a pivot of the pull tab holder for swingably supporting the pull tab is located above the tops of the protuberances.

According to a fifth aspect of the invention, a pivot of the pull tab holder for swingably supporting the pull tab is located substantially at the same level of the tops of the protuberances.

According to a sixth aspect of the invention, the pull tab is indirectly linked to the pull tab holder by way of a link, which has a pair of circular attachment holes and is adapted to be arranged between the protuberances.

According to a seventh aspect of the invention, the pull tab is provided at an end thereof with a holding ring, which is adapted to be arranged between the protuberances and directly linked to the pull tab holder.

DETAILED DESCRIPTION OF THE PREFERRED EMBODIMENTS OF THE INVENTION

Now, the present invention will be described by referring to the accompanying drawings that illustrate preferred embodiments of small and free type slider for a slide fastener according to the invention.

Figure 1:
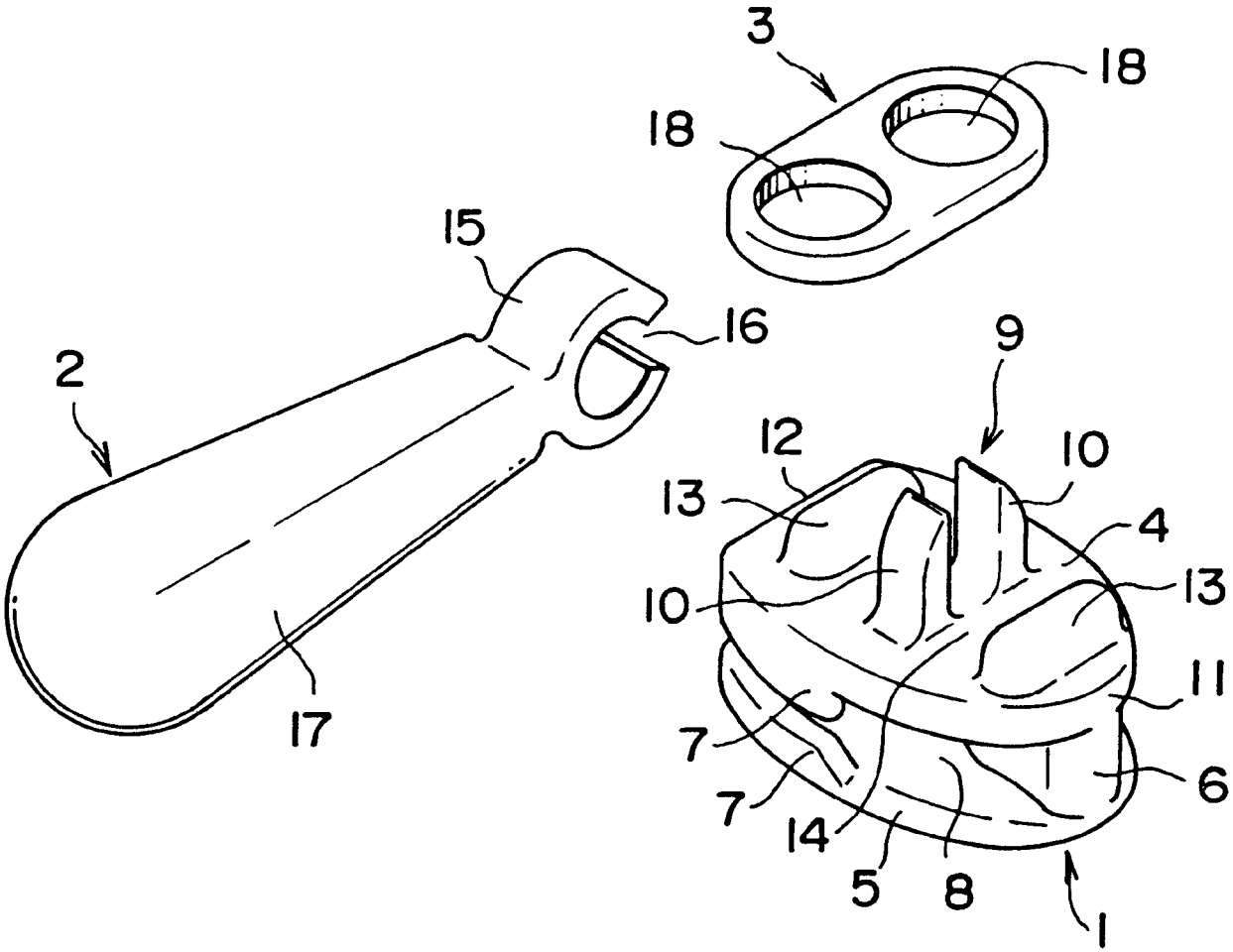
FIG. 1 is an exploded schematic perspective view of a first embodiment of a free type slider for a slide fastener according to the invention.
Figure 7:
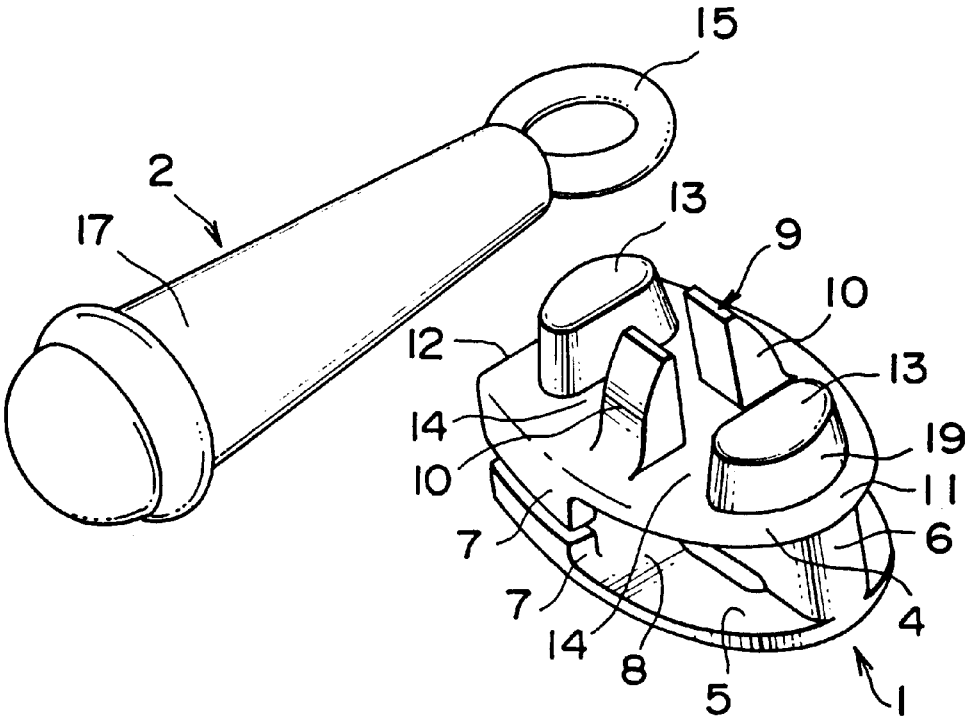
FIG. 7 is an exploded schematic perspective view of a fourth embodiment of a free type slider for a slide fastener according to the invention.
Figure 8:
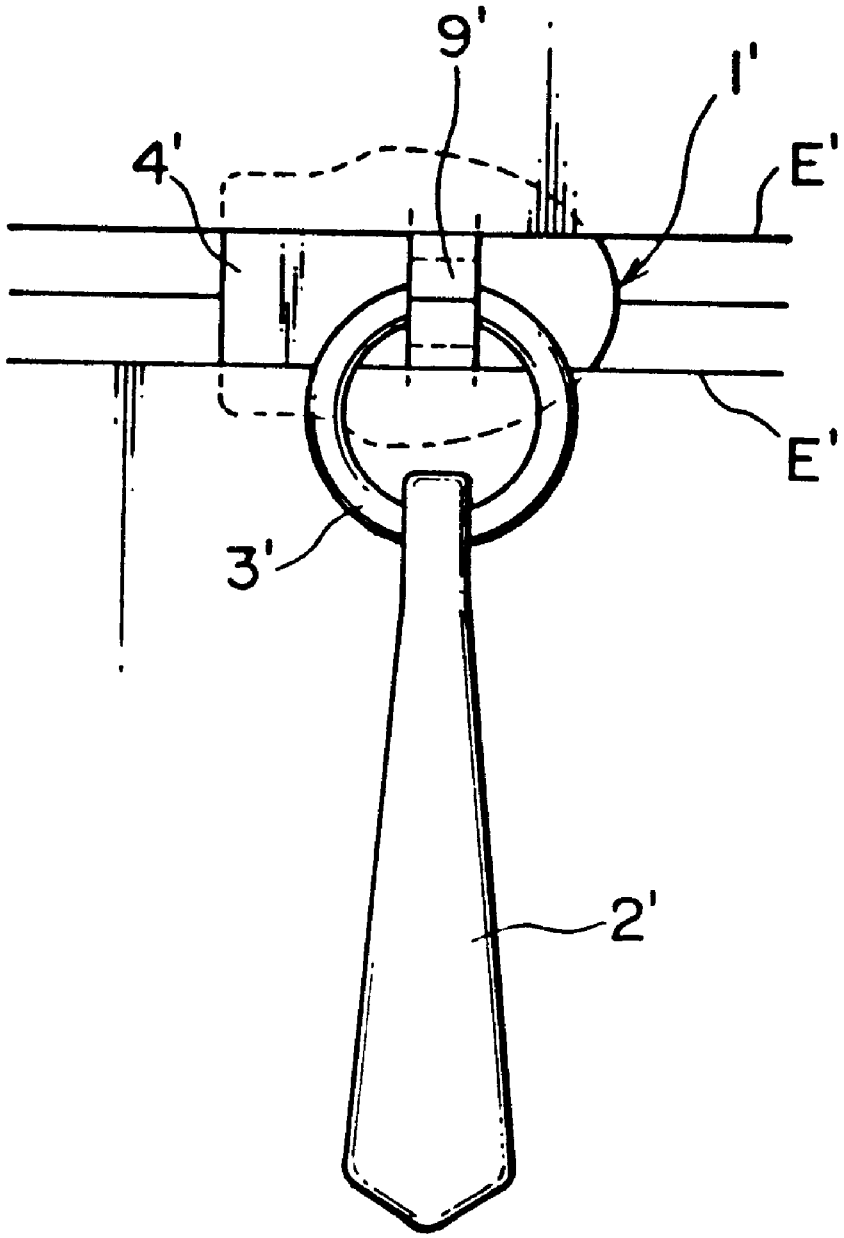
FIG. 8 PRIOR ART
FIG. 8 is a schematic plan view of a known slider for a slide fastener, showing how it operates.
Figure 9:
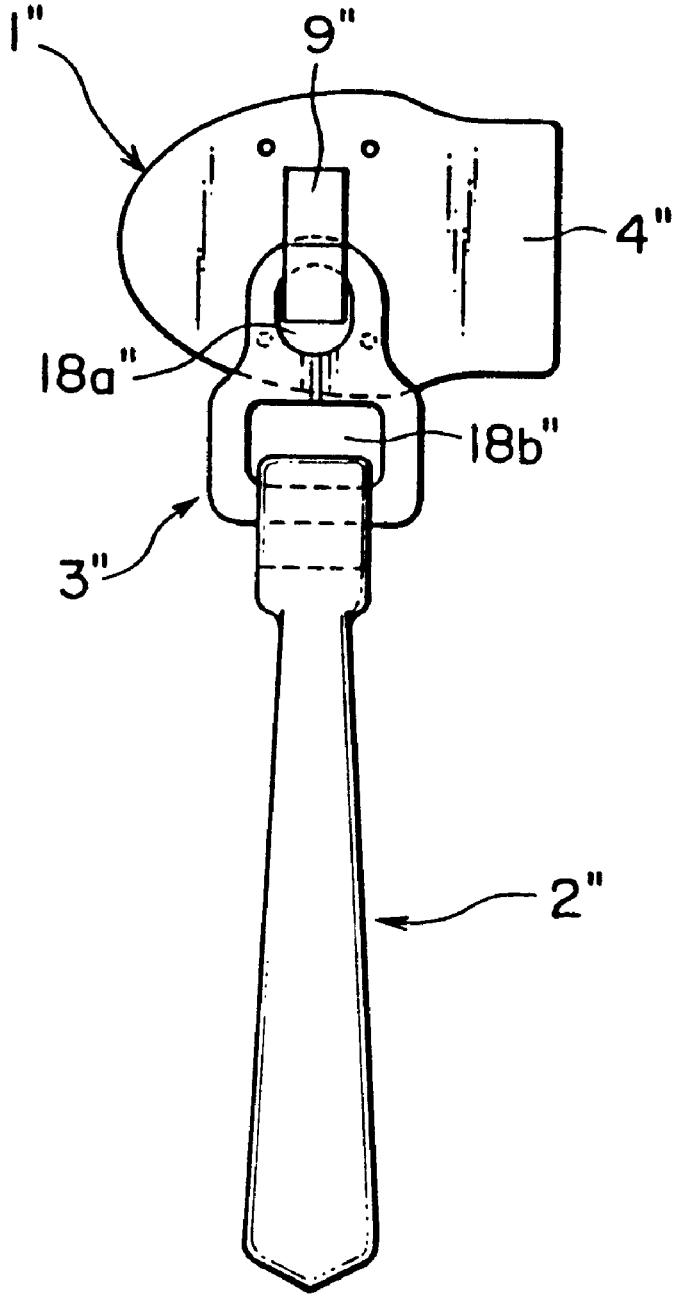
FIG. 9 PRIOR ART
FIG. 9 is a schematic plan view of another known slider for a slide fastener.

A small and free type slider for a slide fastener according to the invention may be a three-piece slider comprising a slider body 1, a pull tab 2 and a link 3 as shown in FIG. 1 or, alternatively, it may be a two-piece slider comprising a slider body 1 and a pull tab 2 as shown in FIG. 7. At least the slider body 1 and the pull tab 2 are made of metal such as aluminum alloy or zinc alloy and formed by die cast molding means and, if used, the link 3 is formed either by die cast molding means or by press means.

FIG. 1 shows an embodiment of a free type slider for a slide fastener comprises a slider body 1 having an upper wing 4, a lower wing 5 and a guide post 6 rigidly linking the upper and lower wings 4, 5, both of which are provided at the lateral sides thereof with respective curved guide flanges 7 defining a guide channel 8 for guiding fastener elements between them. Depending on the design of the fastener elements to be guided, only one of the wings may be provided with guide flanges 7. A pull tab holder 9 for holding a pull tab 2 or a link 3 comprises a pair of legs 10 projecting from about the center of the upper surface of the upper wing 4 to define a U-shaped space therebetween. The pull tab holder 9 is arranged transversally relative to the slider body 1 and a pair of protuberances 13 are projecting upward from the upper surface of the upper wing 4 in front and at the back of the pull tab holder 9 respectively and spaced apart from the pull tab holder 9. These protuberances 13 have a transversally oblong elliptic plan view with a pair of straight transversal edges arranged in parallel and a pair of semicircular opposite edges connected to the straight edges and a curved side view. Flat areas 14 are arranged between the pull tab holder 9 and the respective protuberances 13 to snugly receive the pull tab 2 or the link 3.

Figure 2:
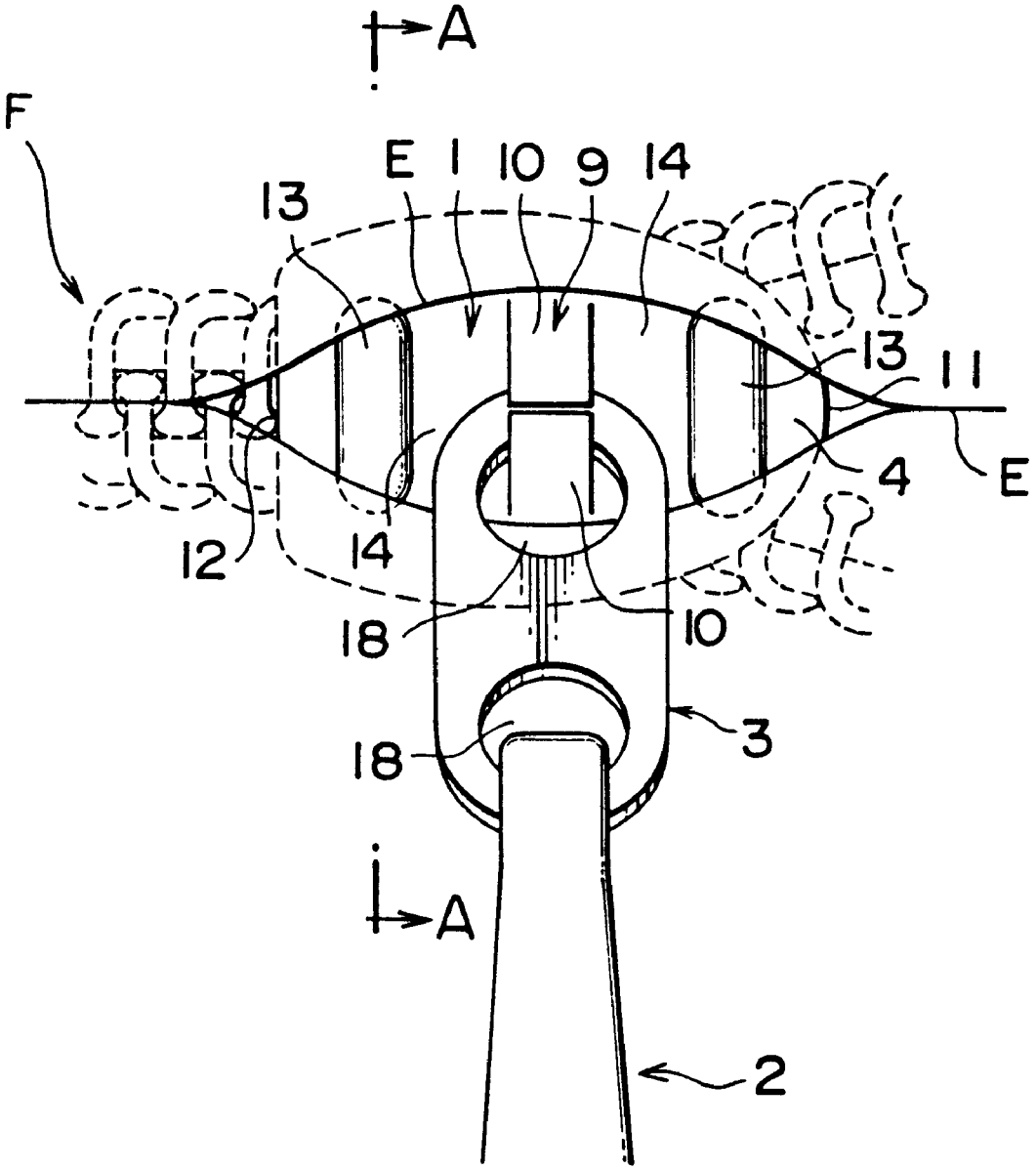
FIG. 2 is a schematic plan view of the embodiment of the slider of FIG. 1, showing how it operates.

The pull tab 2 is provided integrally at an end thereof with a holding ring 15 having a gap 16 and at the opposite end thereof with a grip 17. The link 3 is made of metal and has an oblong elliptic profile with a pair of circular attachment holes 18 bored therethrough so that the link 3 may be secured to the slider body 1 by arranging it between the legs 10 of the pull tab holder 9 and also between the protuberances 13 as shown in FIG. 2 and firmly binding the front ends of the legs 10 by caulking means to make the pull tab holder 9 pass through one of the attachment holes 18 of the link 3. Then, the holding ring 15 of the pull tab 2 is made to pass through the other circular attachment hole 18 of the link 3 and the gap 16 of the holding ring 15 is firmly closed by caulking means so that the pull tab 2 is swingably arranged on the flat areas 14 between the protuberances 13.

Figure 3:
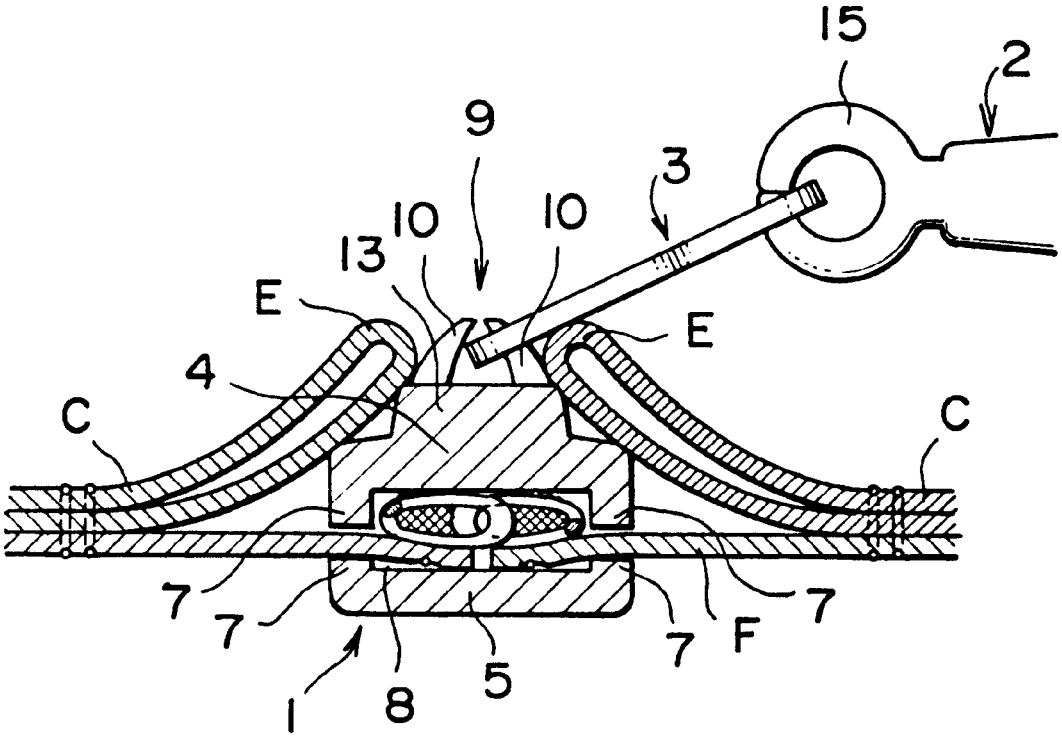
FIG. 3 is a schematic cross sectional view of the embodiment of the slider of FIG. 1 taken along line A—A in FIG. 2 and showing how it operates.
Figure 4:
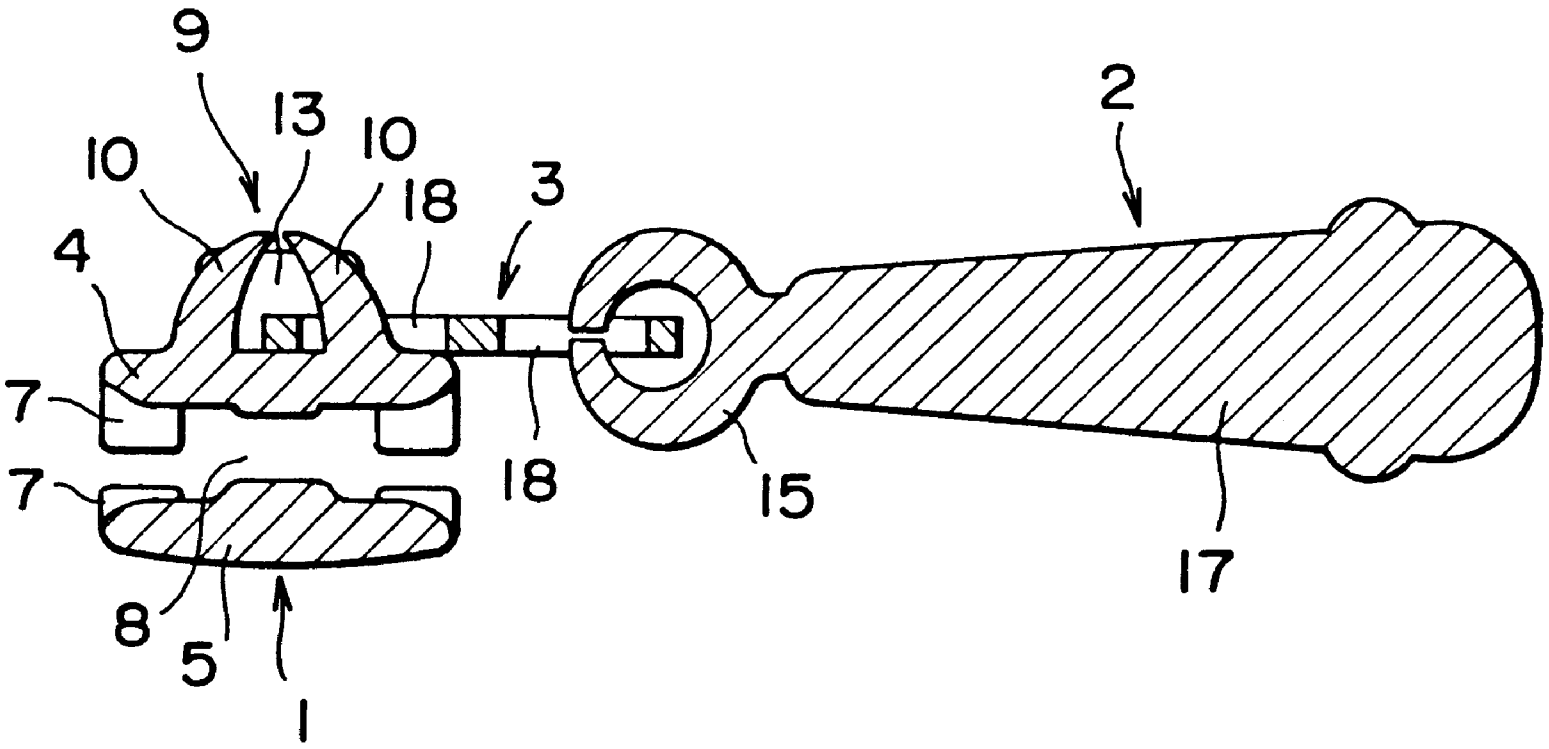
FIG. 4 is a schematic transversal cross sectional view of a second embodiment of a slider for a slide fastener according to the invention.

When the pull tab 2 is fitted to the slider body 1 by way of the link 3, it is preferably so arranged that the pull tab holder 9 is located above the protuberances 13 arranged in front and at the back thereof on the slider body 1 as shown in FIG. 3. With this arrangement, the link 3 may vertically movable and the pivot of the link 3 is found above the protuberances 13. Alternatively, the pull tab holder 9 and the protuberances 13 may have a substantially same height as shown in FIG. 4.

Figure 5:
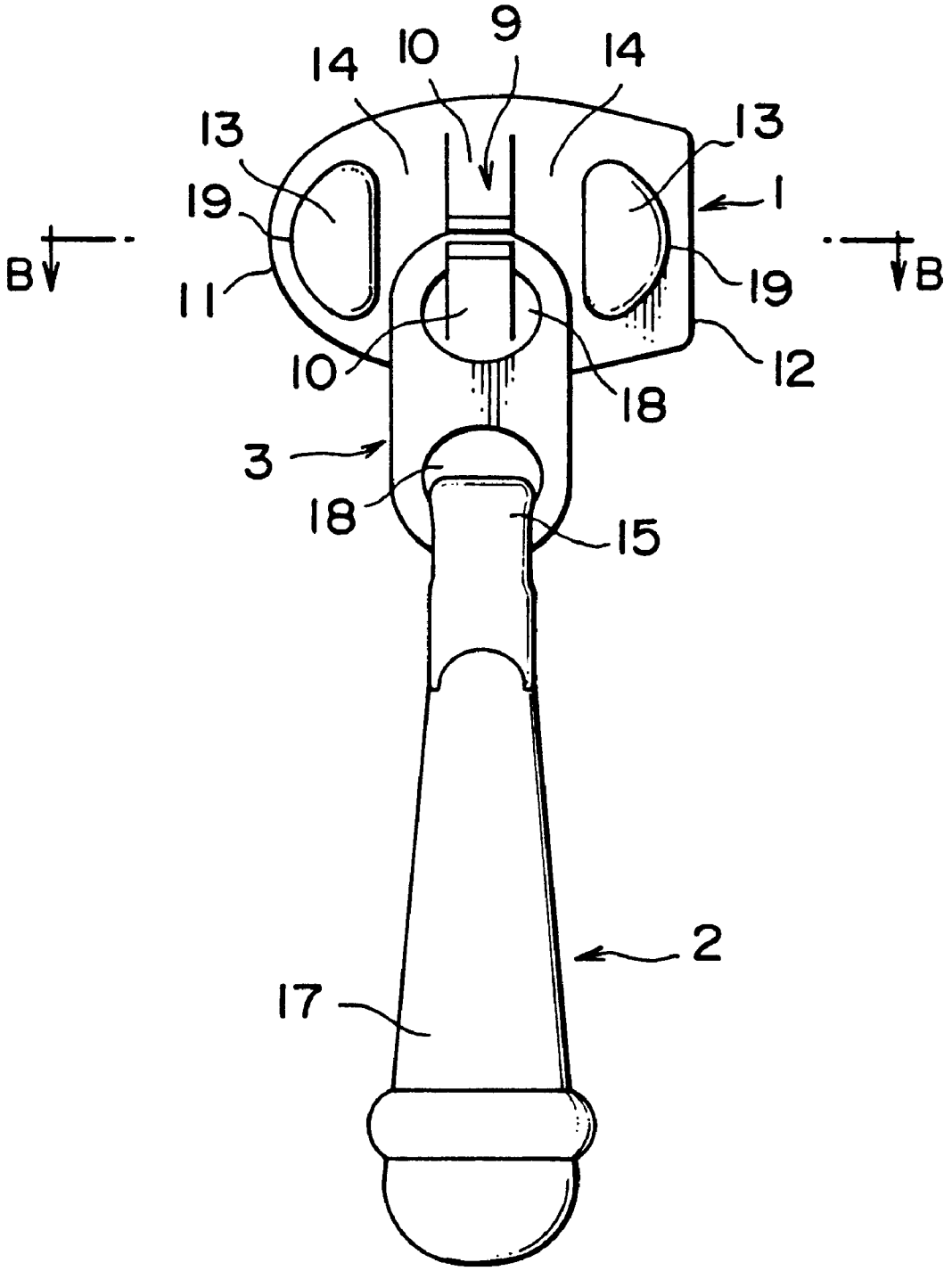
FIG. 5 is a schematic plan view of a third embodiment of slider for a slide fastener according to the invention.
Figure 6:
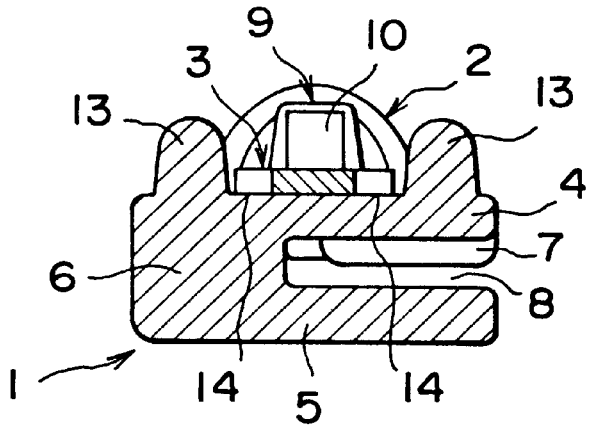
FIG. 6 is a schematic longitudinal cross sectional view of the embodiment of the slider of FIG. 5 taken along line B—B.

The embodiment of slider for a slide fastener illustrated in FIG. 5 differs from the above embodiment in that the front protuberance 13 of the paired protuberances 13 arranged on the upper surface of the upper wing 4 of the slider body 1 has an outwardly curved front edge 19 curved toward the front end 11 of the upper wing 4, whereas the back protuberance 13 has an outwardly curved rear edge 19 curved toward the rear end 12 of the upper wing 4. The pull tab holder 9 and the protuberances 13 may have different heights or, alternatively, have a same height as shown in FIG. 6.

The embodiment of slider for a slide fastener illustrated in FIG. 7 is a two-piece free type slider comprising only a slider body 1 and a pull tab 2, wherein the slider body 1 has a pull tab holder 9 constituted by a pair of legs 10 projecting from about the center of the upper surface of the upper wing 4 to define a U-shaped space therebetween and a pair of protuberances 13 projecting upward from the upper surface of the upper wing 4 in front and at the back of respectively and spaced apart from pull tab holder 9 as in the case of the preceding embodiments. The pull tab 2 has a holding ring 15 without any gap that lies flat as integral part thereof and placed in the U-shaped space between the legs 10 of the pull tab holder 9 standing from the upper wing 4 so that the pull tab 2 is inseparably connected to the pull tab holder 9 and becomes swingable on the flat areas 14 between the protuberances 13 when the front ends of the legs 10 are put together by caulking.

Thus, when a fastener stringer F provided with a small and free type slider for a slide fastener according to the invention and having a feature as described above is secured to the edges of the slit of a pocket of a wearing article having a lining by sewing as shown in FIGS. 2 and 3, edges E of the fabric of the pocket ride on the slider body 1 of the slider but would not be scraped by the pull tab holder 9 because the protuberances 13 arranged in front and at the back of the pull tab holder 9 operate as buffer and softly wedge away the edges E of the fabric before the edges E are scraped by the pull tab holder 9 so that the slider may smoothly move back and forth and hence the problem of the prior art that the pull tab holder 9 scrapes the edges E of the fabric is dissolved. The slider can be operated by pulling the pull tab 2 in a longitudinal direction and, when the slider is at rest and the pull tab 2 is released, the latter become automatically suspended from the slider body 1 in a transversal direction.

A small and free type slider for a slide fastener according to the invention and having a feature as described above provides the following advantages.

According to the first aspect of the invention, there is provided a slider for a slide fastener which comprises a pull tab holder 9 projecting transversally from about the center of the upper surface of the upper wing 4 of the slider body 1, a pair of protuberances 13 projecting upward from the upper surface of the upper wing 4 in front and at the back of the pull tab holder 9 respectively and spaced apart from the pull tab holder 9 so that a pull tab 2 may be directly or indirectly fitted to the pull tab holder 9 and disposed between the protuberances 13 and, therefore, the pull tab 2 can automatically become suspended from the slider body 1 in a transversal direction. With this arrangement, when the fastener stringer F provided with such a slider is fitted to the slit of a pocket of a wearing article, the protuberances 13 arranged in front and at the back of the pull tab holder 9 operate as buffer and softly wedge away the edges E of the fabric before the edges E are scraped by the pull tab holder 9 so that the slider may smoothly move back and forth. Additionally, the edges of the slit may not have to be separated from each other so that a visually neat slit can be formed for the pocket.

According to the second aspect of the invention, partly since the pull tab holder 9 has a pair of legs 10 projecting from the upper surface of the slider body 1 to define a U-shaped space therebetween and partly since the protuberances 13 projecting upward in front and at the back of the pull tab holder 9 have a transversally oblong elliptic plan view, the pull tab 2 or the link 3 can be secured in position simply by placing it between the legs 10 and binding and caulking the ends of the legs so that the slider can be assembled in a simple manner and the protuberances 13 operate as buffer and softly wedge away the edges E of the fabric before the edges E are scraped by the pull tab holder 9 to allow the slider to move smoothly back and forth.

According to the third aspect of the invention, partly since the pull tab holder 9 has a pair of legs 10 projecting from the upper surface of the slider body 1 to define a U-shaped space therebetween and partly since the protuberances 13 projecting upward in front and at the back of the pull tab holder 9 have generally semicircular plan views with their respective arched edges curved toward the front and rear ends 11, 12 of the upper wing 4, the pull tab 2 or the link 3 can be secured in position simply by placing it between the legs 10 and binding and caulking the ends of the legs so that the slider can be assembled in a simple manner and the protuberances 13 operate as buffer and softly wedge away the edges E of the fabric particularly due to the outwardly curved outer edges 19 of the protuberances 13 before the edges E are scraped by the pull tab holder 9 to allow the slider to move smoothly back and forth.

According to the fourth aspect of the invention, since the pivot of the pull tab holder 9 for swingably supporting the link 3 is located above the tops of the protuberances 13, the pivot of the pull tab 2 or the link 3 does not provide any obstacle for operating the slider so that the slider can be operated lightly without damaging the fabric and the pull tab 2 becomes automatically suspended from the slider body 1 in a transversal direction to make it appear neat.

According to the fifth aspect of the invention, since the pivot of the pull tab holder 9 for swingably supporting the link 3 is located substantially at the level of the tops of the protuberances 13, any external pressure applied to the slider by a press iron, for example, can be distributed. Additionally, since the pivot is located at a relatively low level, the pulling force of the pull tab 2 can be accurately transmitted to the slider body 1.

According to the sixth aspect of the invention, since the pull tab 2 is indirectly linked to the pull tab holder 9 by way of a link 3 having a pair of circular attachment holes 18 and adapted to be arranged between the protuberances 13, the pull tab 2 can swing freely in any direction relative to the slider body 1 and hence the slider can be pulled easily and smoothly.

According to the seventh aspect of the invention, since the pull tab 2 is provided at an end thereof with an integral holding ring 15 adapted to be arranged between the protuberances 13 and directly linked to the pull tab holder 9, the pull tab 2 can swing freely in any direction relative to the slider body 1 and hence the slider can be pulled easily and smoothly. Additionally, the pulling force of the pull tab 2 can be accurately transmitted to the slider body 1.

What is claimed is:

1. A slider for a slide fastener, comprising:

a slider body having and upper wing, a lower wing, a guide post rigidly linking said upper and lower wings, and a pull tab holder having first and second transversely spaced portions projecting from about a center of an upper surface of said upper wing; and a pair of protuberances projecting upward from said upper surface of said upper wing in front and at the back of said pull tab holder respectively and longitudinally spaced apart from said pull tab holder; and a pull tab directly or indirectly linked to said slider body.

2. A slider for a slide fastener according to claim 1, wherein said pull tab holder having first and second transversely spaced portions includes a pair of legs projecting from said upper surface of said slider body to define a U-shaped space therebetween and said protuberances projecting upward in front and at the back of said pull tab holder have a transversally oblong elliptic plan view.

3. A slider for a slide fastener according to claim 1, wherein said pull tab holder having first and second transversely spaced portions includes a pair of legs projecting from said upper surface of said slider body to define a U-shaped space therebetween and said protuberances projecting upward in front and at the back of said pull tab holder have generally semicircular plan views with their respective arched edges curved toward front and rear ends of said upper wing.

4. A slider for a slide fastener according to claim 1, wherein a pivot of said pull tab holder for swingably supporting said pull tab is located above tops of said protuberances.

5. A slider for a slide fastener according to claim 1, wherein a pivot of said pull tab holder for swingably supporting said pull tab is located substantially at the level of tops of said protuberances.

6. A slider for a slide fastener according to claim 1, wherein said pull tab is indirectly linked to said pull tab holder by way of a link having a pair of circular attachment holes and adapted to be arranged between said protuberances.

7. A slider for a slide fastener according to claim 1, wherein said pull tab is provided at an end thereof with a holding ring adapted to be arranged between said protuberances and directly linked to said pull tab holder.

8. A slider for a slider fastener, comprising:

a slider body having an upper wing, a lower wing, a guide post rigidly linking said upper and lower wings, a pull tab holder projecting transversally from about a center of an upper surface of said upper wing, and a pair of protuberances projecting upward from said upper surface of said upper wing in front and at the back of said pull tab holder respectively and spaced apart from said pull tab holder; and a pull tab directly or indirectly linked to said slider body;

wherein said pull tab holder includes a pair of legs projecting from said upper surface of said slider body to define a U-shaped space therebetween and said protuberances projecting upward in front and at the back of said pull tab holder have a transversally oblong elliptic plan view.

9. A slider for a slider fastener, comprising:

a slider body having an upper wing, a lower wing, a guide post rigidly linking said upper and lower wings, a pull tab holder projecting transversally from about a center of an upper surface of said upper wing, and a pair of protuberances projecting upward from said upper surface of said upper wing in front and at the back of said pull tab holder respectively and spaced apart from said pull tab holder; and a pull tab directly or indirectly linked to said slider body;

wherein said pull tab holder includes a pair of legs projecting from said upper surface of said slider body to define a U-shaped space therebetween and said protuberances projecting upward in front and at the back of said pull tab holder have generally semicircular plan views with their respective arched edges curved toward front and rear ends of said upper wing.

* * * * *